US010342347B2

(12) United States Patent
Cheng

(10) Patent No.: US 10,342,347 B2
(45) Date of Patent: Jul. 9, 2019

(54) ROTATABLE BRACKET STRUCTURE

(71) Applicant: Gold Classic Enterprise Ltd., New Taipei (TW)

(72) Inventor: Chung-Ying Cheng, New Taipei (TW)

(73) Assignee: GOLD CLASSIC ENTERPRISE LTD., New Taipei (TW)

( * ) Notice: Subject to any disclaimer, the term of this patent is extended or adjusted under 35 U.S.C. 154(b) by 0 days.

(21) Appl. No.: 16/006,808

(22) Filed: Jun. 12, 2018

(65) Prior Publication Data

US 2019/0082839 A1 Mar. 21, 2019

(30) Foreign Application Priority Data

Sep. 20, 2017 (TW) ..... 106213988 U

(51) Int. Cl.
*A47B 96/07* (2006.01)
*A47K 10/04* (2006.01)
*A47H 1/102* (2006.01)

(52) U.S. Cl.
CPC ..... *A47B 96/07* (2013.01); *A47H 1/102* (2013.01); *A47K 10/04* (2013.01)

(58) Field of Classification Search
USPC ..... 248/265
See application file for complete search history.

(56) References Cited

U.S. PATENT DOCUMENTS 2,056,874 A * 10/1936 Updegraff ..... A47H 1/122 248/265
2,199,851 A * 5/1940 Culver ..... A47H 1/102 211/104
5,026,012 A * 6/1991 Wang ..... A47K 10/10 248/222.14
5,076,523 A * 12/1991 Wang ..... A47K 10/10 248/222.14
7,926,772 B2 * 4/2011 Lowe ..... A47K 10/10 248/220.21
8,382,051 B2 * 2/2013 Smith ..... A47K 10/10 211/105.1
2009/0206220 A1 * 8/2009 Forrest ..... A47K 3/003 248/251
2011/0297632 A1 * 12/2011 Goldstein ..... A47H 1/022 211/105.6
2013/0092646 A1 * 4/2013 Wang ..... A47H 1/022 211/123
2016/0081519 A1 * 3/2016 Manko ..... A47K 10/04 211/16

* cited by examiner

*Primary Examiner* — Monica E Millner
(74) *Attorney, Agent, or Firm* — Leong C. Lei

(57) ABSTRACT

A rotatable bracket structure includes a frame body and a fixation seat in connection with the frame body, where the frame body is configured with an engagement portion, and the fixation seat a sleeve, the inside of the fixation seat configured with a unidirectional rotating structure having an axle shaft allowed to be fixed to the engagement portion after passed through the sleeve, Furthermore, an elastic element is put around the axle shaft and positioned between the unidirectional rotating structure and sleeve. Whereby, the two fixation seats, upon assembly, are fixed to a wall surface, and the two frame bodies are properly rotated an angle to allow the two frame bodies to clamp and position a rod body through the unidirectional rotating structure to form a hanging frame after the two ends of the rod body are passed through the respective frame bodies, thus achieving a convenient, quick assembly.

5 Claims, 6 Drawing Sheets

ROTATABLE BRACKET STRUCTURE

TECHNICAL FIELD OF THE INVENTION

The present invention relates to a rotatable bracket structure, and more particularly to a rotatable bracket structure, allowing the assembly of a hanging frame to be more convenient and not subject to the limitation of construction space constraints.

DESCRIPTION OF THE PRIOR ART

Hanging frames for the hanging of curtain cloth, towels, clothes and the like are usually be configured with two symmetrical brackets. Upon assembly construction of a hanging frame, one of the two brackets is first fixed on a wall surface, a rod body is passed through the bracket and another identical bracket, and the two brackets are then respectively fixed on the wall surface, or a rod body is first passed through the two brackets, and the two brackets are respectively fixed on the wall surface. Since the two conventional brackets respectively are a fixed type on the assembly, they are not only very inconvenient in the construction operation but further increase the difficulty of it if the space for the construction is too narrow. In addition, the conventional bracket is designed with the diameter of the diameter of the rod body such that manufacturers must make the rod brackets of different sizes to match with the rod bodies of different diameters, which not only increases the production cost but has the pressure of stock material.

SUMMARY OF THE INVENTION

The main object of the present invention is to provide a rotatable bracket structure, allowing the assembly of a hanging frame to be more convenient and quick and not to be limited by construction space, and capable of in combination with rod bodies of different diameters.

To achieve the object mentioned above, the present invention proposes a rotatable bracket structure, including a frame body and a fixation seat in connection with the frame body, where the frame body is configured with an engagement portion, and the fixation seat a sleeve, the inside of the fixation seat configured with a unidirectional rotating structure having an axle shaft allowed to be fixed to the engagement portion after passed through the sleeve, Furthermore, an elastic element is put around the axle shaft and positioned between the unidirectional rotating structure and sleeve. Whereby, the two fixation seats, upon assembly, are fixed to a wall surface, and the two frame bodies are properly rotated an angle to allow the two frame bodies to clamp and position a rod body through the unidirectional rotating structure to form a hanging frame after the two ends of the rod body are passed through the respective frame bodies, thus allowing the assembly of the hanging frame to be more convenient and quick.

According to the rotatable bracket structure, the unidirectional rotating structure comprises a ratchet ring configured inside the fixation seat and a volute button bar portion having an axle shaft, the ratchet ring is configured with a continuously arranged ratchet teeth, the volute button bar portion a plurality of button bars in a volute arrangement, the volute button bar portion is positioned on an inner surface of the rear cover of the fixation seat, whereby, when the volute button bar portion is rotated forward, the volute button bar portion is rotatable smoothly since the button bars are slidable along inclined faces of the ratchet teeth, and when the volute button bar portion is rotated reversely, the volute button bar portion is unable to be rotated since the button bars are stuck in included angles between the two adjacent ratchet teeth, thus achieving a one-way rotation effect.

According to the rotatable bracket structure mentioned above, the unidirectional rotating structure is a one-way bearing, a movable axle shaft is configured on a center of the one-way bearing, allowing the one-way bearing to be fixed to an inner surface of the rear cover of the fixation seat, and the axle shaft is passed through the sleeve of the front cover of the fixation seat after put around with an elastic element; the axle shaft is fixed to the engagement portion of the frame body, allowing the elastic element to be positioned between the one-way bearing and the sleeve of the front cover, the axle shaft is allowed to be in engagement with the center of the one-way bearing by means of the elasticity of the elastic element, and the frame body to be rotated in one single direction through the one-way bearing.

DETAILED DESCRIPTION OF THE PREFERRED EMBODIMENTS

Figure 1:
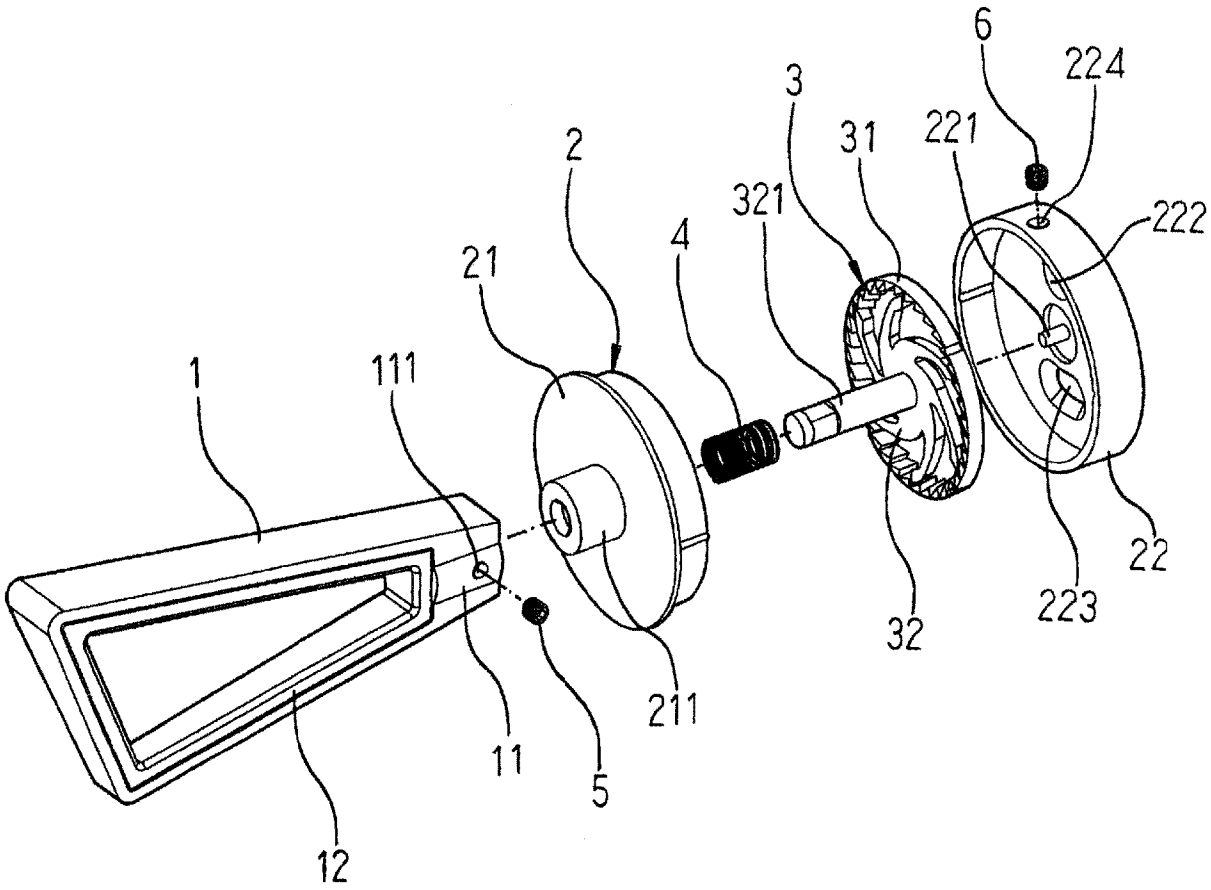
FIG. 1 is an exploded view of the present invention.
Figure 2:
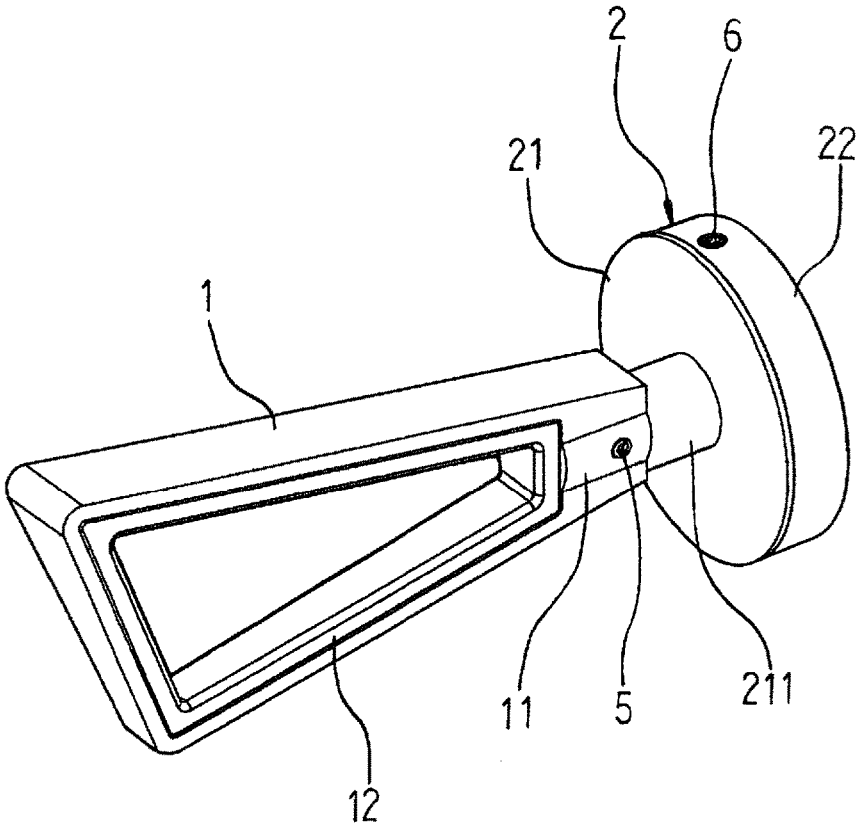
FIG. 2 is a perspective view of the present invention.
Figure 3:
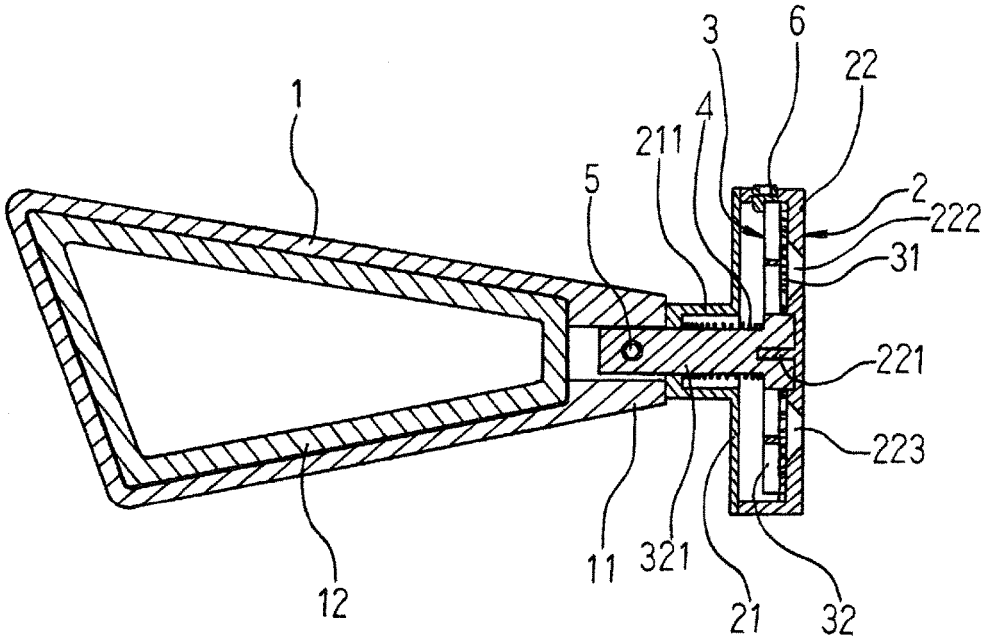
FIG. 3 is a cross-sectional view of the present invention.

Referring to FIGS. 1, 2 and 3, a rotatable bracket structure of the present invention includes a frame body 1 and a fixation seat 2 in connection with the frame body 1, where the frame body 1 is a probably trapezoidal body, one end of which is configured with an engagement portion 11 having a fixation hole 111, and the inner edge of which is configured with a rubber element 12. The fixation seat 2 includes a front cover 21 and rear cover 22, where the front cover 21 is configured with a cylindrical sleeve 211, and the center of inner surface of the rear cover 22 a positioning rod 221. Furthermore, positioning holes 222, 223 are respectively configured at the two sides of the positioning rod 221 and a fixation hole 224 is configured on the peripheral of the rear cover 22.

A unidirectional rotating structure 3 is configured inside of the fixation seat 2. In the embodiment, the unidirectional rotating structure 3 includes a ratchet ring 31 configured inside the fixation seat 2 and a volute button bar portion having an axle shaft, where the ratchet ring 31 is configured with a plurality of ratchet teeth arranged continuously, and the volute button bar portion 32 a plurality of button bars in a volute arrangement, allowing the volute button bar portion 32 to be in engagement with the positioning rod 221 and positioned thereby, thereby allowing the volute button bar portion 32 to be rotated smoothly because the ends of the button bar s can be slid along the inclined surfaces of the ratchet teeth when the volute button bar portion 32 is rotated forward, and the volute button bar portion 32 not to be rotated because the ends of the button bars are stuck in the included angles between the two adjacent ratchet teeth when the volute button bar portion 32 is rotated reversely so that the volute button bar portion 32 can only be rotated in a single direction.

Upon the assembly of the present invention, the axle shaft 321 of the volute button bar portion 32 of the unidirectional rotating structure 3 is put around with an elastic element 4 and then inserted in the sleeve 211 of the front cover 21 of the fixation seat 2, and a screw 5 is locked into the fixation hole 111 of the engagement portion 11 of the frame body 1 to fox the axle shaft 321, allowing the elastic element 4 to be positioned between the volute button bar portion 32 and sleeve 211 of the front cover 21, and thus allowing the button bars of the volute button bar portion 32 to bee pressed against the ratchet teeth of the ratchet ring 31 by means of the elasticity of the elastic element 4. Whereby, on assembly, the two fixation seats 1 are fixed to a wall surface through the fixation holes 222, 223, and each front cover 21 and rear cover 22 are then engaged fixedly with each other by locking the screw 6 into the fixation hole 224. Thereafter, the two ends of a rod body are passed through the respective frame bodies 1, and the two frame bodies 1 are then rotated properly an angle to clamp and position the rod body through the unidirectional rotating structure 3 so as to form a hanging frame, thereby allowing towels, clothes and the like to be hung on the rod body and thus allowing the assembly of the hanging frame to be more convenient and quick. In addition, when the hanging frame needs to be detached, the frame body 1 is pulled outward to separate the button bars of the volute button bar portion 32 from the ratchet teeth so that the frame body 1 can be rotated to allow the rod body to be taken out.

Figure 4:
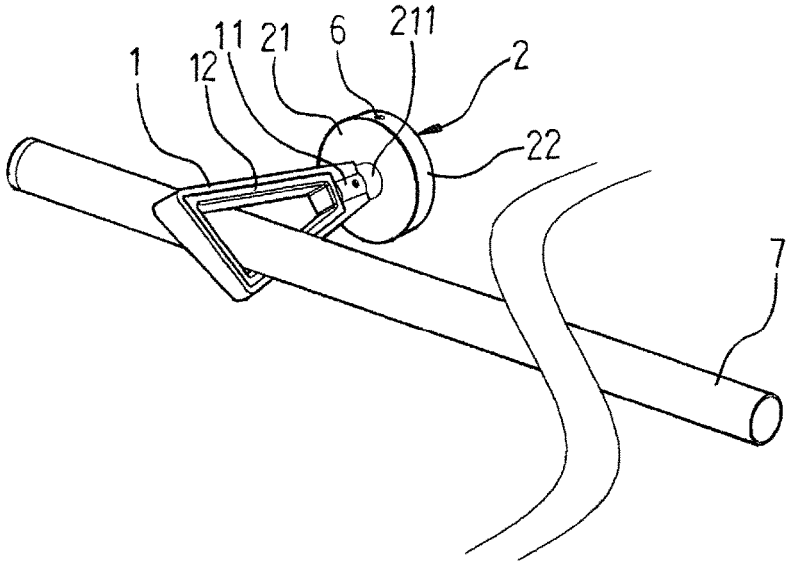
FIGS. 4 and 5 respectively are a perspective view of the present invention in an assembly state.
Figure 5:
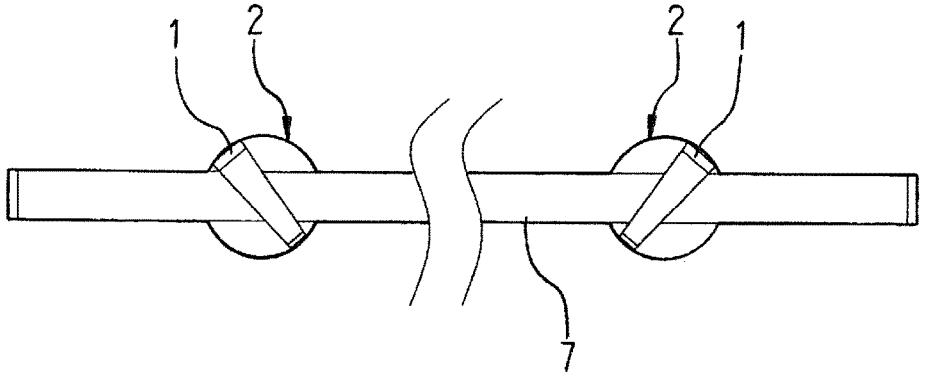

Referring to FIGS. 4 and 5, as well as FIGS. 1 and 2 again, the two fixation seats 2, upon the assembly, are fixed on a wall surface, and each frame body 1 is rotated properly an angle after the two ends of a rod body 7 are passed through the respective frame bodies 1 to clamp and position the rod body 7 through the unidirectional rotating structure 3 to form a hanging frame (one of the two frame bodies 1 may be rotated to be vertically positioned to facilitate the pass-through of one end of the rod body 7 and then rotated to be horizontally positioned to allow another end of the rod body 7 to be passed through another frame body 1, and each frame boy 1 is finally turned a proper angle), thereby allowing towels, clothes and like to be hung on the rod body 7, and further allowing the assembly of the frame body to be more convenient and quick. In addition, each frame body 1 only needs to be pulled outward and can then be turned to allow the rod body 7 to be taken out upon the detachment of the rod body 7. It is worth mentioning that the rubber elements 12 configured on the inner edge of the frame body 1 can prevent the rod body 7 from being damaged when the rod body 7 is clamped by the two framed bodies 1.

Therefore, the assembly of the hanging frame is not limited by construction space according to present invention since the frame body 1 can be rotated freely, and the width of the inner edge is progressively from small to large because the frame body 1 is trapezoidal such that it can be matched with rod bodies 7 of different diameters, allowing the construction to be more convenient, and the production cost to be decreased and the pressure on stock material to be reduced because the present invention does not need to cooperate with different diameter rod bodies 7 to manufacture different molds . . .

Figure 6:
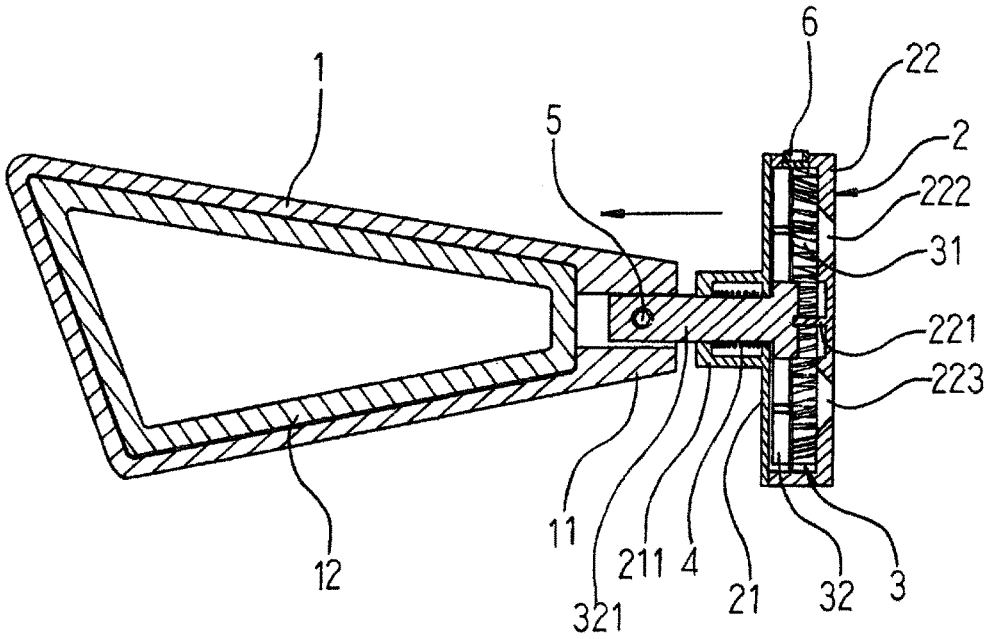
FIG. 6 is a cross-sectional view of the present invention in a detachment state.

Referring to FIG. 6, and referring to FIGS. 4 and 5 again, the volute button bar portion 32 of the unidirectional rotating structure 3 of the present invention is pressed against the ratchet teeth the ratchet ring 31 by means of the elasticity of the elastic element 4 under a normal condition, thus allowing the frame body 1 to rotated in a unidirectional way so as to be beneficial to pass the two ends of the rod body 7 through the two frame bodies 1 and fixed by them. Furthermore, the button bars of the volute button bar portion 32 are allowed to be separated from the ratchet teeth of the ratchet teeth of the ratchet ring 31 only by pulling the frame body 1 outward, and the frame bodies 1 can then be rotated to allow the rod body 7 to be taken out so that the operations of the assembly and detachment of the rod boy 7 are very convenient and quick.

Figure 7:
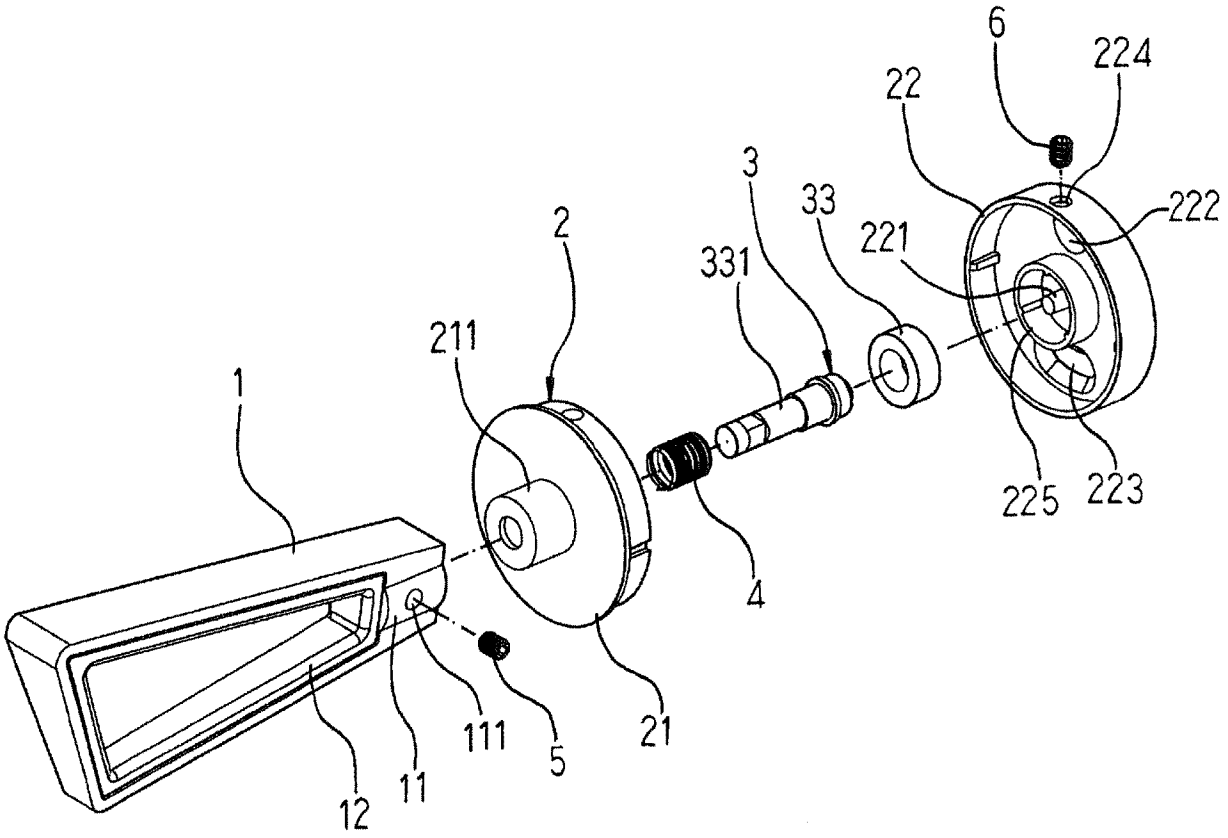
FIG. 7 is an exploded view of another preferred embodiment of the present invention.

Referring to FIG. 7, the unidirectional rotating structure 3 of the present invention, in another preferred embodiment, may be configured with a one-way bearing 33 except for the above combination of ratchet ring 31 with the volute button bar portion 32, where the center of the one0way bearing 33 is configured with a movable axle shaft 331, and the inner surface of the rear cover 22 of the fixation seat 2 an annular wall 225. Here, the one-way bearing 33 is engaged with the annular wall 225 and fixed thereby, and the axle shaft 331 is passed through the sleeve 211 of the front cover 21 of the fixation seat 2 after an elastic element 4 is put around the axle shaft 331. Thereafter, a screw 4 is locked into the fixation hole 111 to fix the axle shaft 331 to allow the elastic element 34 to be positioned between the one-way bearing 33 and the sleeve 211 of the front cover 21 so that the axle shaft 331 is in engagement with the center of the one-way bearing 33 by means of the elasticity of the elastic element 34, allowing the frame body 1 to be rotated in one way or the axle shaft 331 to be separated from the center of the one-way tearing 33 when the frame body 1 is pulled outward so as to facilitate forward-reverse rotation of the frame body 1.

I claim:

1. A rotatable bracket structure, comprising:

a frame body, one end thereof configured with an engagement portion;

a fixation seat, comprising a front cover and rear cover, said front cover configured with a cylindrical sleeve, and said rear cover configured with a fixation hole; and a unidirectional rotating structure, configured inside said fixation seat, and having an axle shaft put around with an elastic element, said axle shaft then passed through a sleet of said front cover of said fixation seat and in engagement with said engagement portion of said frame body and fixed thereto, allowing said elastic element to be positioned between said unidirectional rotating structure and said sleeve of said front cover;

whereby, two fixation seats, upon assembly, are fixed to a wall surface, and two frame bodies are properly rotated an angle to allow said two frame bodies to clamp and position a rod body through said unidirectional rotating structure to form a hanging frame after two ends of said rod body are passed through respective frame bodies, thus allowing an assembly of said hanging frame to be more convenient and quick;

wherein said unidirectional rotating structure comprises a ratchet ring configured inside said fixation seat and a volute button bar portion having an axle shaft, said ratchet ring is configured with a continuously arranged ratchet teeth, said volute button bar portion a plurality of button bars in a volute arrangement, said volute button bar portion is positioned on an inner surface of said rear cover of said fixation seat, whereby, when said volute button bar portion is rotated forward, said volute button bar portion is rotatable smoothly since said button bars are slidable along inclined faces of said ratchet teeth, and when said volute button bar portion is rotated reversely, said volute button bar portion is unable to be rotated since said button bars are stuck in included angles between two adjacent ratchet teeth, thus achieving a one-way rotation effect.

2. The bracket structure according to claim 1, wherein said frame body is a trapezoidal body for rod bodies of different diameters.

3. The bracket structure according to claim 1, wherein an inner edge of said frame body is configured with a rubber element adapted to protect said rod body from being damaged.

4. The bracket structure according to claim 1, wherein a positioning rod adapted to be in engagement with said unidirectional rotating structure and positioned thereby is configured on a center of an inner surface of said rear cover.

5. The bracket structure according to claim 1, wherein said unidirectional rotating structure is a one-way bearing, a movable axle shaft is configured on a center of said one-way bearing, allowing said one-way bearing to be fixed to an inner surface of said rear cover of said fixation seat, and said axle shaft is passed through said sleeve of said front cover of said fixation seat after put around with an elastic element; said axle shaft is fixed to said engagement portion of said frame body, allowing said elastic element to be positioned between said one-way bearing and said sleeve of said front cover, said axle shaft is allowed to be in engagement with said center of said one-way bearing by means of the elasticity of said elastic element, and said frame body to be rotated in one single direction through said one-way bearing.

* * * * *